US006216275B1

(12) United States Patent
Lee

(10) Patent No.: US 6,216,275 B1
(45) Date of Patent: Apr. 17, 2001

(54) NECKTIE WITH FIXING DEVICE

(76) Inventor: Chong Lim Lee, 274-5 Shacheonjin-ri, Shacheon-myun, Kangreung-shi, Kangwon-do (KR)

( * ) Notice: Subject to any disclaimer, the term of this patent is extended or adjusted under 35 U.S.C. 154(b) by 0 days.

(21) Appl. No.: 09/610,285

(22) Filed: Jul. 6, 2000

(30) Foreign Application Priority Data

Mar. 31, 2000 (KR) ..... 00-16933

(51) Int. Cl.[7] ..... A41D 25/00
(52) U.S. Cl. ..... 2/144; 2/145; 2/149
(58) Field of Search ..... 2/144, 145, 149; 24/13, 49.1, 51, 55, 54, 58, 65, 66.1, 66.2

(56) References Cited

U.S. PATENT DOCUMENTS

| | | | | |
|---|---|---|---|---|
| 2,990,551 | * | 7/1961 | Schreter et al. | 2/141 |
| 3,487,471 | * | 1/1970 | Hagen | 2/141 |
| 5,007,139 | | 4/1991 | Ahern | 24/49 R |
| 5,046,221 | | 9/1991 | Walker | 24/49 R |
| 5,052,083 | * | 10/1991 | Hammer | 24/66.2 |
| 5,235,730 | | 8/1993 | Townswnd | 24/49 R |
| 5,337,457 | * | 8/1994 | Chennault | 24/66.4 |
| 5,353,438 | | 10/1994 | Voiles | 2/145 |
| 5,715,538 | * | 2/1998 | Soll | 2/145 |
| 5,815,836 | * | 10/1998 | Jacobson, II | 2/145 |

* cited by examiner

*Primary Examiner*—Gloria M. Hale
(74) *Attorney, Agent, or Firm*—Eric Bleich

(57) ABSTRACT

A necktie with fixing device embodies a simple, self-contained, convenient and more economic way to maintain a necktie in place. The fixing device comprises an anchoring member that is secured to the rear surface of the wide end of the necktie, an elastic member secured to center of the anchoring member, a small magnet that is secured to the end of the elastic member opposite that secured to the anchoring member, and a hook extending from the magnet. The elastic member is long enough to allow the magnet to engage a zipper, belt buckle or other metallic fastening element of a clothing article, and allow the hook to removably engage fastening elements of clothing articles such as zippers, belt buckles and buttons. The combined securing action of the magnet and hook allow the fixing device to maintain the wide end of a necktie in place. The hook, when inserted in the aperture in the zipper handle of a fly-type trousers closure, also insures that the zipper will not inadvertently open, thereby preventing the embarrassment of the wearer associated therewith.

1 Claim, 3 Drawing Sheets

NECKTIE WITH FIXING DEVICE

BACKGROUND OF THE INVENTION

1. Field of the Invention

This invention relates to a necktie, particularly to a necktie having a convenient and efficient fixing device having a hook and a magnet connected to the lower rear side of the necktie. A wearer of the necktie of the present invention can use the fixing device to both maintain his tie in place and secure the fastener of his pants. Use of the necktie and fixing device of the present invention eliminates the need for tie clips, pins and tacks, which can be both expensive and easily lost.

2. Description of the Prior Art

The necktie is an accessory that figures prominently in male formal dress, in both social and professional contexts, and has the ability to accentuate an otherwise nondescript outfit.

However, when a necktie is worn, the lower part of the necktie swings back and forth, or even around to its backside or the necktie is flipped over the shoulder and back of a wearer. The tendency of a necktie to move about in this fashion can make it an inconvenient and distracting item of apparel.

To solve this problem, the lower part of a necktie is fixed to a shirt by using accessaries such as a tie pin tie clip, or tie tack to prevent the excessive movement of the necktie.

However, such accessories are often expensive, and can easily be lost while worn. Furthermore, tie pins, clips and tacks may damage both the necktie and the shirt in wear.

An additional problem that occurs in men's attire is the inadvertent opening of the zipper "fly" closures of trousers in public. A neglected or accidental opened fly zipper can be the source of embarrassment, shame and ridicule in public.

SUMMARY OF THE INVENTION

The necktie with fixing device of the present invention presents a simple, self-contained, convenient and more economic way to maintain a necktie in place. The fixing device includes an anchoring member that is secured to the rear surface of the wide end of a necktie. One end of an elastic member is secured to the anchoring member at or near its center. The opposite end of the elastic member attaches to a small magnet, which in turn connects to a hook extending therefrom, preferably in a curved trajectory. The elastic member is long enough to allow the magnet to magnetically engage a zipper, belt buckle or other metallic fastening element of a clothing article, and allow the hook to removably engage fastening elements of clothing articles such as zippers or belt buckles. The combined securing action of the magnet and hook allow the fixing device to maintain the wide end of a necktie in place. The hook can also engage other fastening elements of clothing articles such as buttons, buttonholes, clasps and the like to maintain the necktie in place.

The hook element of the present invention, when inserted in the aperture in the zipper handle of a fly-type trousers closure, also insures that the zipper will not inadvertently open.

Accordingly, it is a principal object of the present invention to maintain the wide end of a necktie in place during wear.

It is a further object of the invention to provide a simple, self-contained, convenient and more economic way to maintain the wide end of a of necktie, without the use of a tie pin, tie clip, or tie tack.

It is another object of the invention to maintain closure of a fly-type trousers closure to prevent embarrassment, shame and ridicule in public.

It is also an object of the invention to provide improved elements and arrangements thereof in an apparatus for the purposes described which is inexpensive, dependable and fully effective in accomplishing its intended purpose.

These and other objects of the present invention will become readily apparent upon further review of the following specification and drawings.

BRIEF DESCRIPTIONS OF THE DRAWINGS

DESCRIPTION OF THE PREFERRED EMBODIMENT

Figure 1:
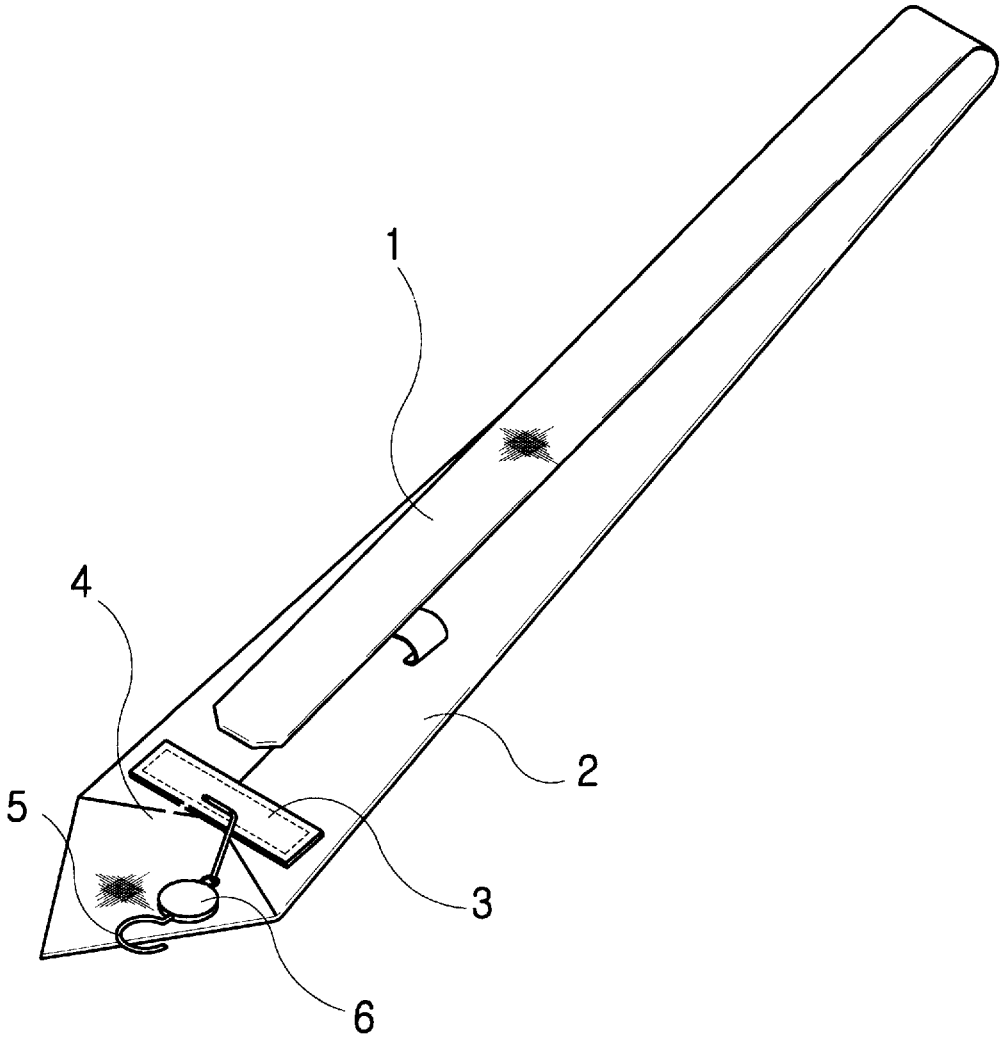
FIG. 1 is a perspective view showing the necktie with fixing device according to the present invention.

Referring now to the drawings, the preferred embodiments according to this invention is described in detail.

In FIG. 1, an anchoring member 3 is secured to the rear surface of the wide end 2 of a necktie 1, so as to be substantially perpendicular to the longer axis of necktie 1. One end of an elastic member 4 is secured to anchoring member 3, preferably at the center thereof, at a point along the longer axis of necktie 1. A small magnet 6 is secured to the other end of elastic member 4. A hook 5 integrally connects to magnet 6, and extends therefrom, preferably in a curved trajectory. Elastic member 4 is of sufficient length to allow magnet 6 to magnetically engage a zipper, belt buckle or other metallic fastening element of a clothing article; and allow hook 5 to removably engage fastening elements of clothing articles such as zippers, belt buckles and buttons. In cooperation, anchoring member 3, elastic member 4, magnet 6 and hook 5 comprise the fixing device of the present invention.

Figure 2:
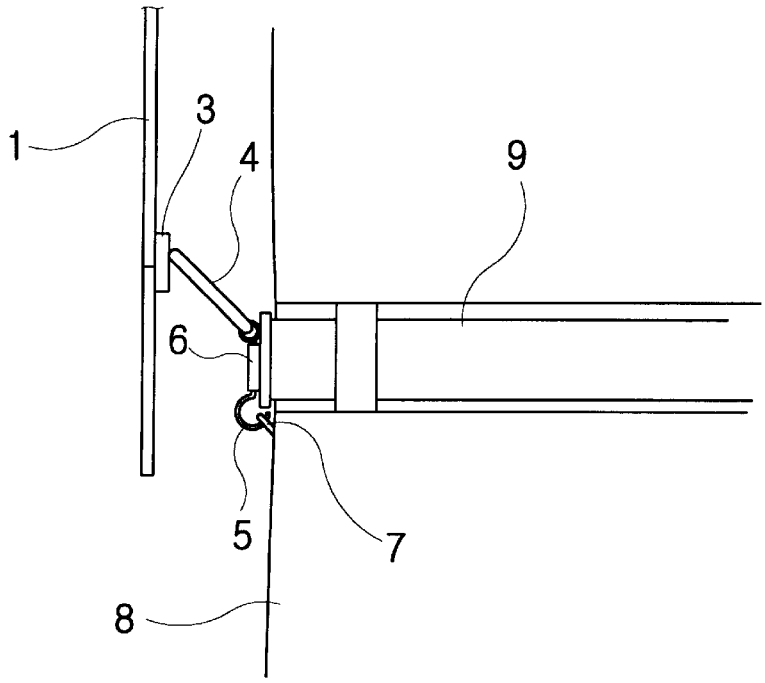
FIG. 2 is a side environmental view of the necktie with fixing device of the present invention, shown engaging the belt buckle and zipper fly handle of a wearer.

When the necktie of this invention is worn, as shown in FIG. 2, the hook is put into the aperture of a zipper handle 7 of a fly type closure is trousers 8 and, and secure therein. Magnet 6 is attached to the buckle of a belt 9, The combined securing action of hook 5 in the zipper 7 and magnet 6 on the buckle of belt 9 maintains necktie 1 in place and prevents the zipper 7 from slipping down inadvertently.

Elastic band 4 of the fixing device of the present invention allows it to be adjusted according to the height of a wearer. Elastic band 4 is not attached directly to the rear surface of wide end 2 of necktie 1 but to the center portion of anchoring member 3 to prevent the front surface of necktie 1 from wrinkling due to the tension of elastic member 3 pulling thereon when hook 5 and magnet 6 are engaged.

Figure 3:
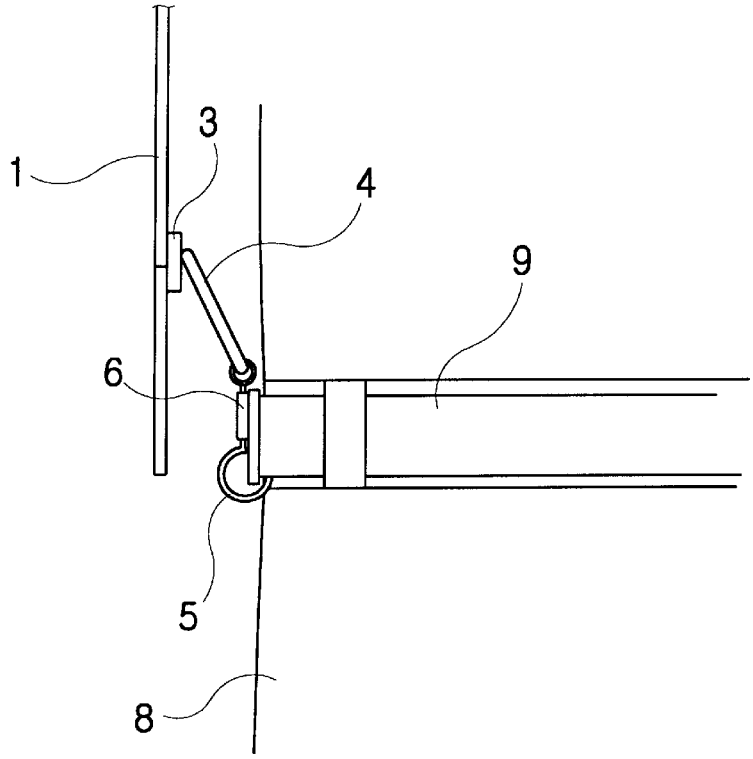
FIG. 3 is a side environmental view of the necktie with fixing device of the present invention, shown engaging the belt buckle of a wearer.

FIG. 3 shows another way of fastening the fixing device of the present invention. Hook 5 insertably engages the underside of the buckle of belt 9. Magnet 6 is attached to the buckle. The combined securing action of hook 5 and magnet 6 on the buckle of belt 9 maintains necktie 1 in place.

Figure 4:
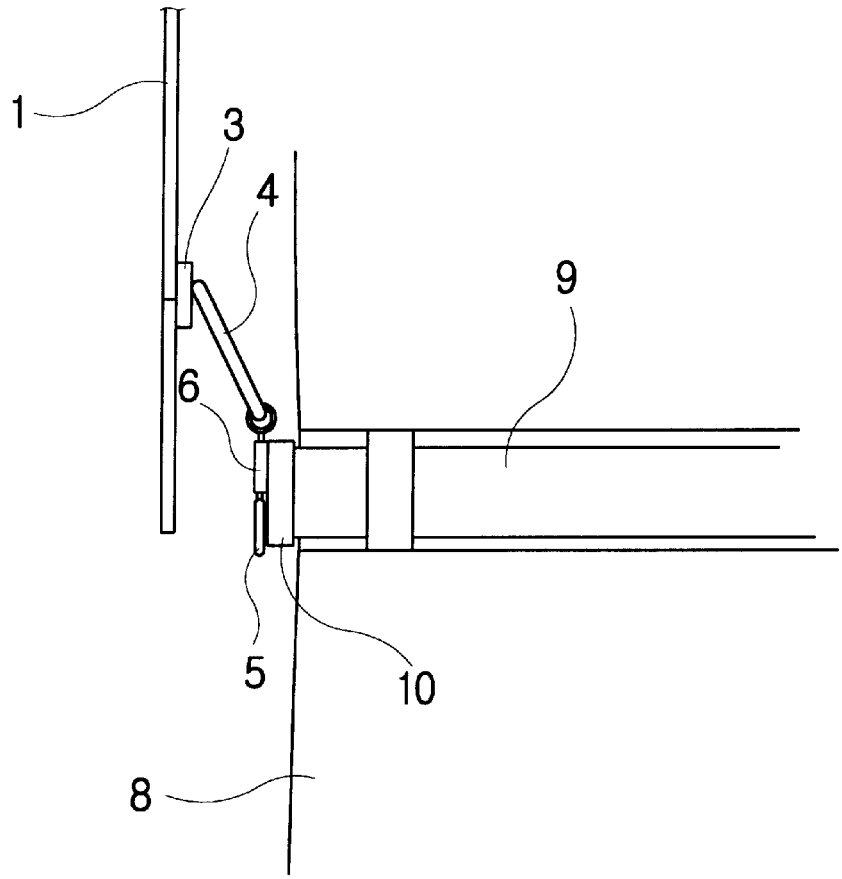
FIG. 4 is a side environmental view of the necktie with fixing device of the present invention, shown engaging the belt buckle of a wearer in an alternative position.

FIG. 4 shows another way of fastening the fixing device of the present invention. Magnet 6 is attached to the front part of the metal buckle 10 of the belt 9 for maintaining necktie 1 in place.

Alternatively, hook 5 and the magnet 6 of the present invention can be used with other fastening elements of clothing articles such as buttons, button holes 2 clasps and the like to maintain wide end 2 of necktie 1 in place.

The necktie with fixing device according to this invention as described affords a simple, self-contained, convenient and more economic way to maintain the wide end of a necktie in place without the use of an expensive necktie pin tie clip, or tack. The present invention also prevents inadvertent opening of the zipper "fly" closures of trousers in public, thereby allowing the wearer to avoid potential embarrassment, shame and ridicule in public.

What is claimed is:

1. A necktie having a front side and a rear side and having a narrow upper end and a wider lower end, said necktie having a fixing device including a fixing band sealed to said wider lower end on said rear side, said fixing band having a center portion, said fixing device comprising a magnetic member and a hook member and an elastic member, wherein said magnetic member and said hook member form a body which is connected to said elastic band member and wherein said elastic band member is bound to said center portion of said fixing band.

* * * * *